US010436453B2

(12) United States Patent
Kühn et al.

(10) Patent No.: US 10,436,453 B2
(45) Date of Patent: Oct. 8, 2019

(54) INSULATION DEVICE, DOOR AND DOMESTIC COOKING DEVICE

(71) Applicant: BSH Hausgeräte GmbH, Munich (DE)

(72) Inventors: Robert Kühn, Palling (DE); Dan Neumayer, Bernau (DE); Philipp Schaller, Traunreut (DE)

(73) Assignee: BSH Hausgeräte GmbH, Munich (DE)

( * ) Notice: Subject to any disclaimer, the term of this patent is extended or adjusted under 35 U.S.C. 154(b) by 0 days.

(21) Appl. No.: 15/326,659

(22) PCT Filed: Jul. 23, 2015

(86) PCT No.: PCT/EP2015/066911
§ 371 (c)(1),
(2) Date: Jan. 17, 2017

(87) PCT Pub. No.: WO2016/016096
PCT Pub. Date: Feb. 4, 2016

(65) Prior Publication Data

US 2017/0205080 A1 Jul. 20, 2017

(30) Foreign Application Priority Data

Jul. 29, 2014 (DE) ..... 10 2014 214 833

(51) Int. Cl.
*F24C 15/04* (2006.01)
*F24C 15/34* (2006.01)

(52) U.S. Cl.
CPC ..... *F24C 15/04* (2013.01); *F24C 15/34* (2013.01)

(58) Field of Classification Search
USPC ..... 126/200
See application file for complete search history.

(56) References Cited

U.S. PATENT DOCUMENTS 3,692,015 A * 9/1972 Chase ..... F24C 14/02 126/200
3,921,438 A * 11/1975 Katsuta ..... F17C 3/06 73/40.7
6,209,265 B1 * 4/2001 Banicevic ..... F25D 23/02 49/382
2006/0027230 A1 * 2/2006 Jung ..... F24C 15/04 126/200

(Continued)

FOREIGN PATENT DOCUMENTS

DE 19520040 A1 12/1996
DE 19734959 C1 11/1998
EP 0151359 B1 5/1988

(Continued)

OTHER PUBLICATIONS

International Search Report PCT/EP2015/066911 dated Oct. 8, 2015.
National Search Report DE 10 2014 214 833.2 dated Oct. 15, 2015.

*Primary Examiner* — Avinash A Savani
(74) *Attorney, Agent, or Firm* — Michael E. Tschupp; Andre Pallapies; Brandon G. Braun

(57) ABSTRACT

An insulation device for a door of domestic cooking device includes a first pane, a second pane and a frame arranged between the first pane and the second pane and connected thereto. The frame is made of a foam material, e.g. a foamed inorganic material. The foam material can be closed-pore and configured so as to be impermeable to steam.

20 Claims, 4 Drawing Sheets

(56) References Cited

U.S. PATENT DOCUMENTS

2010/0154783 A1* 6/2010 Colson ..... E04C 1/42
126/619

FOREIGN PATENT DOCUMENTS

| | | | |
|---|---|---|---|
| EP | 2239511 | A1 | 10/2010 |
| WO | 2010130559 | A1 | 11/2010 |
| WO | 2013083474 | A1 | 6/2013 |
| WO | 2013164464 | A2 | 11/2013 |

* cited by examiner

INSULATION DEVICE, DOOR AND DOMESTIC COOKING DEVICE

CROSS-REFERENCES TO RELATED APPLICATIONS

This application is the U.S. National Stage of International Application No. PCT/EP2015/066911, filed Jul. 23, 2015, which designated the United States and has been published as International Publication No. WO 2016/016096 A1 and which claims the priority of German Patent Application, Serial No. 10 2014 214 833.2, filed Jul. 29, 2014, pursuant to 35 U.S.C. 119(a)-(d).

BACKGROUND OF THE INVENTION

The present invention relates to an insulation device, a door and a domestic cooking appliance.

A door of a domestic cooking appliance has at least one inner pane and an outer pane arranged at a distance from the inner pane. The inner pane here faces a cooking compartment of the domestic cooking appliance and the outer pane faces the surroundings of the domestic cooking appliance. An air gap can be provided between the inner pane and the outer pane. The air gap acts in a thermally insulating manner. The panes are connected to one another by means of a frame which can be made of a plastic material or a metal material.

BRIEF SUMMARY OF THE INVENTION

With this in mind it is one object of the invention to provide an improved insulation device.

An insulation device for a door of a domestic cooking appliance is therefore proposed with a first pane, a second pane and a frame arranged between the first pane and the second pane and connected thereto. The frame is made of a foam material.

Because the frame is made of a foam material, it acts in an insulating manner. This enhances the insulation effect. The panes are preferably transparent.

According to one embodiment the foam material is a foamed inorganic material.

The foam material is produced for example from a mixture of the inorganic material and a propellant. The propellant serves to form pores or cavities in the foam material.

According to a further embodiment the foam material is closed-pore. "Closed-pore" here means that cavities or pores in the foam material are closed off. In particular the pores or cavities are not connected to one another. This further improves the insulation effect, as there can be no exchange of air between the pores or cavities.

According to a further embodiment the foam material is impermeable to steam.

This reliably prevents steam penetrating into a gap between the panes. This prevents the panes steaming up.

According to a further embodiment the foam material is a foam glass.

This allows the frame to be produced at particularly low cost. For example the frame is cut from a foam glass plate. The foam glass also preferably has an identical or at least similar coefficient of thermal expansion to the material of the panes. This means that the action of heat does not result in stresses due to different coefficients of thermal expansion. The use of foam glass as the frame material prevents the formation of a thermal bridge, as foam glass is an efficient insulator. Foam glass can also be easily recycled, together with the panes. There is no need for a hybrid structure, in other words a glass and metal or plastic composite, for the frame material. The use of foam glass as the frame material has a weight advantage compared with a welded metal frame. Regions of the panes can be printed or coated so the frame is concealed.

According to a further embodiment the frame is bonded to the panes.

In particular the frame is bonded to the panes with the aid of a silicone material. The silicone material is preferably heat-resistant.

According to a further embodiment a gap is provided between the first pane and the second pane. The frame runs around the gap.

The gap is preferably an air gap. The gap is not connected to the surroundings of the insulation device. The gap can also be evacuated. This enhances the insulation effect.

According to a further embodiment an insulating body for thermal insulation purposes is arranged in the gap.

This enhances the insulation effect of the insulation device.

According to a further embodiment the insulating body is transparent.

This means that the insulation device can also be used in doors with a viewing pane.

According to a further embodiment the insulating body comprises fumed silica, an aerogel, a xerogel and/or a cyrogel.

These materials can be hygroscopic. Because the foam material is impermeable to water, the insulating body cannot absorb moisture. As a result the insulating body maintains its thermal insulation properties in the long term.

According to a further embodiment the first pane and/or the second pane is/are made of a soda lime glass or a borosilicate glass.

Borosilicate glass is preferably used for high-temperature applications, in particular in domestic cooking appliances with pyrolysis function.

A door for a domestic cooking appliance is also proposed. The door comprises such an insulation device.

According to one embodiment the door has a third pane, the second pane being arranged between the first pane and the third pane.

The first pane, the second pane and the third pane can all be held by the frame together. The third pane preferably faces the surroundings of the door. The first pane of the insulation device preferably faces a cooking compartment of the domestic cooking appliance. An air gap is preferably provided between the third pane and the second pane.

According to a further embodiment the door has a fourth pane, the first pane and the second pane being arranged between the third pane and the fourth pane.

An air gap is preferably provided between the fourth pane and the first pane and a further air gap is preferably provided between the second pane and the third pane. Air can pass through the air gap between the second pane and the third pane.

A domestic cooking appliance with such an insulation device and/or such a door is also proposed.

Further possible implementations of the insulation device, the door and/or the domestic cooking appliance also comprise combinations not specifically cited of features or embodiments described above or in the following in respect of the exemplary embodiments. The person skilled in the art will also add individual aspects to improve or supplement the respective basic form of the insulation device, the door and/or the domestic cooking appliance.

BRIEF DESCRIPTION OF THE DRAWINGS

Further advantageous configurations and aspects of the insulation device, the door and/or the domestic cooking appliance are the subject matter of the subclaims and the exemplary embodiments of the insulation device, the door and/or the domestic cooking appliance described in the following. The insulation device, the door and/or the domestic cooking appliance are also described in more detail based on preferred embodiments with reference to the accompanying figures, in which:

DETAILED DESCRIPTION OF EXEMPLARY EMBODIMENTS OF THE PRESENT INVENTION

Figure 1:
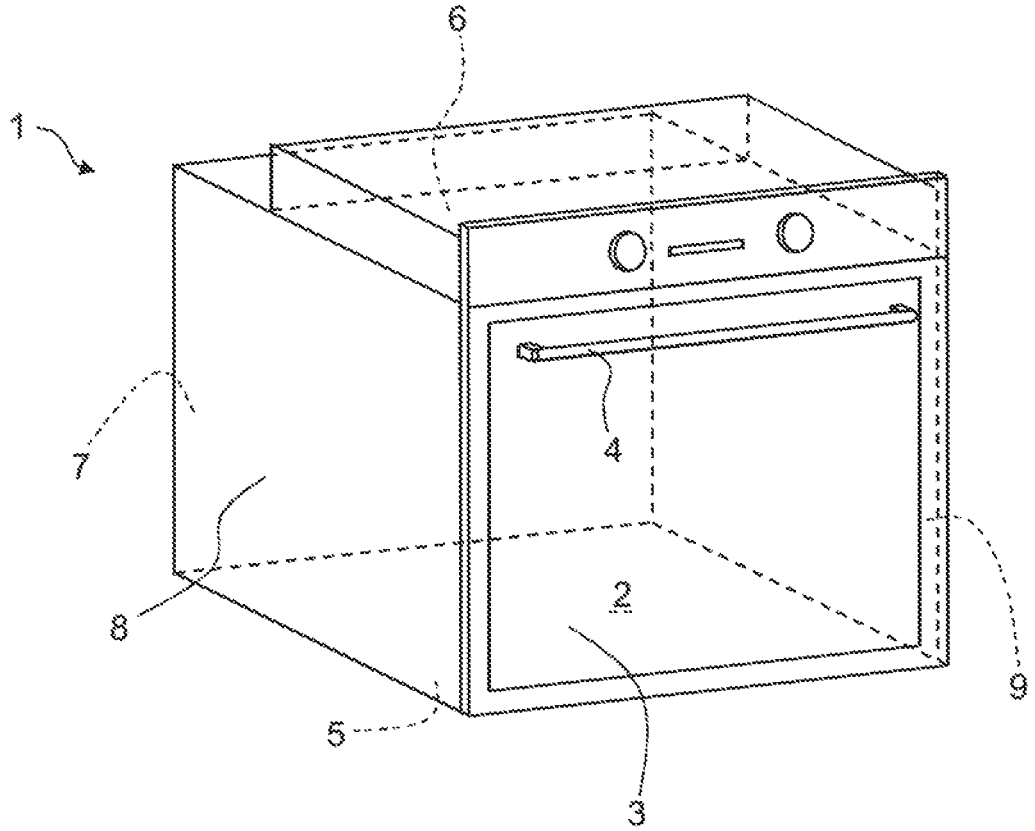
FIG. 1 shows a schematic perspective view of an embodiment of a domestic cooking appliance.

Identical elements or those of identical function are shown with the same reference characters in the figures, unless otherwise stated.

FIG. 1 shows a schematic perspective view of an embodiment of a domestic cooking appliance 1. The domestic cooking appliance 1 is for example an oven, a microwave appliance, an oven with microwave function or the like. The domestic cooking appliance 1 has a muffle or a cooking compartment 2, which can be closed by a door 3. The door 3 is shown in its closed position in FIG. 1. The door 3 can be closed or opened by a pivoting movement about a pivot axis provided at a lower end of the door 3. Alternatively the door 3 can be hinged at the side of the cooking compartment 2. The door 3 can also be arranged on an oven carriage that can be drawn out of the cooking compartment 2. A handle 4 can be provided on an upper segment of the door 3.

The cooking compartment 2 has a base 5, a top 6 arranged opposite the base 5, a rear wall 7 arranged opposite the door 3 and two opposingly arranged side walls 8, 9. The cooking compartment 2 is preferably quadrangular or cuboid. The cooking compartment 2 can be made of a metal material, in particular sheet steel.

Figure 2:
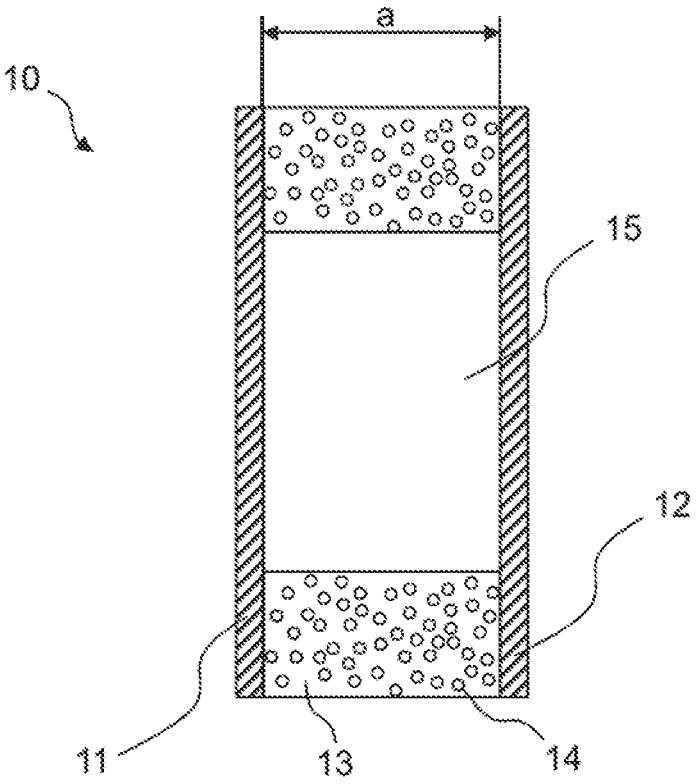
FIG. 2 shows a schematic sectional view of an embodiment of an insulation device for a door of the domestic cooking appliance according to FIG. 1.

The door 3 can comprise an insulation device 10 shown in a schematic sectional view in FIG. 2. The insulation device 10 has a first pane 11 and a second pane 12. The panes 11, 12 are preferably arranged at a distance a from one another. The panes 11, 12 are preferably positioned parallel to one another. The first pane 11 and/or the second pane 12 is/are preferably made of a soda lime glass or a borosilicate glass. In particular the panes 11, 12 are transparent. Segments of the panes 11, 12 can be printed, coated or covered so that regions of the panes 11, 12 are non-transparent.

The insulation device 10 also has a frame 13 arranged between the first pane 11 and the second pane 12 and connected thereto. The frame 13 is made of a foam material. The foam material is in particular a foamed inorganic material. The foamed material is closed-pore. In other words pores 14 or cavities present in the frame are not connected to one another. This means that the foam material is impermeable to steam. The foam material is in particular a foam glass. The foam material can have the same chemical and physical properties as the panes 11, 12. In particular the foam material can have the same coefficient of thermal expansion as the panes 11, 12. The frame 13 is preferably bonded to the panes 11, 12. For example the frame 13 can be bonded to the panes 11, 12 with the aid of a silicone material. The frame 13 can be made for example by water jet cutting or milling from a foam glass plate. The frame 13 can be a single piece of material. Alternatively the frame 13 can be made up of a number of frame elements.

Figure 3:
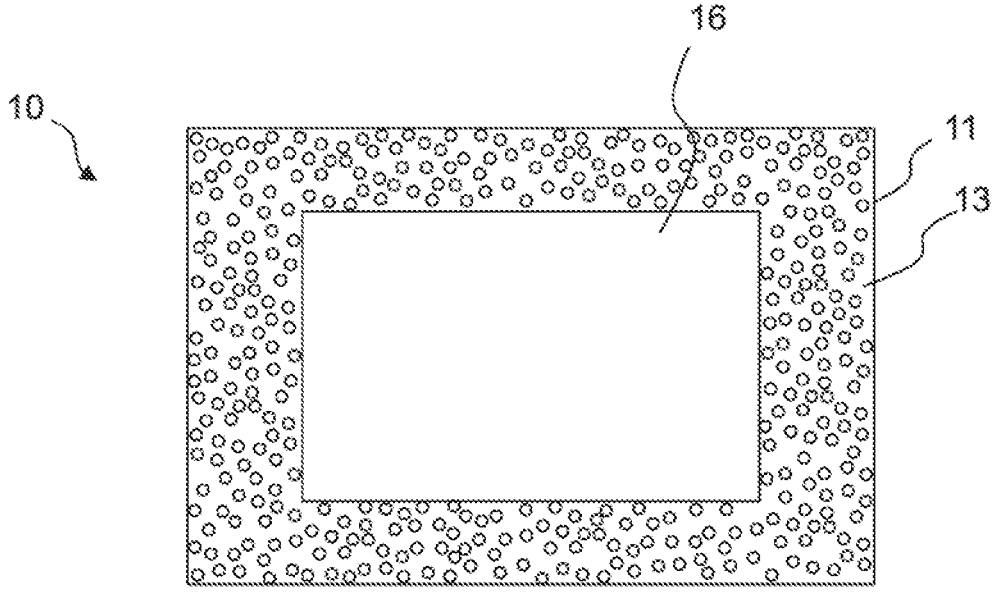
FIG. 3 shows a further schematic sectional view of the insulation device according to FIG. 2.

As shown in FIG. 2, the frame 13 is arranged in its entirety between the panes 11, 12. A gap 15 is provided between the panes 11, 12. As shown in FIG. 3, the frame 13 runs all the way around the gap 15. The frame 13 covers the panes 11, 12 apart from a transparent viewing window 16. Because the foam material is impermeable to steam, no moisture can penetrate into the gap 15. Air for example is provided in the gap 15. The gap 15 can also be evacuated.

Figure 4:
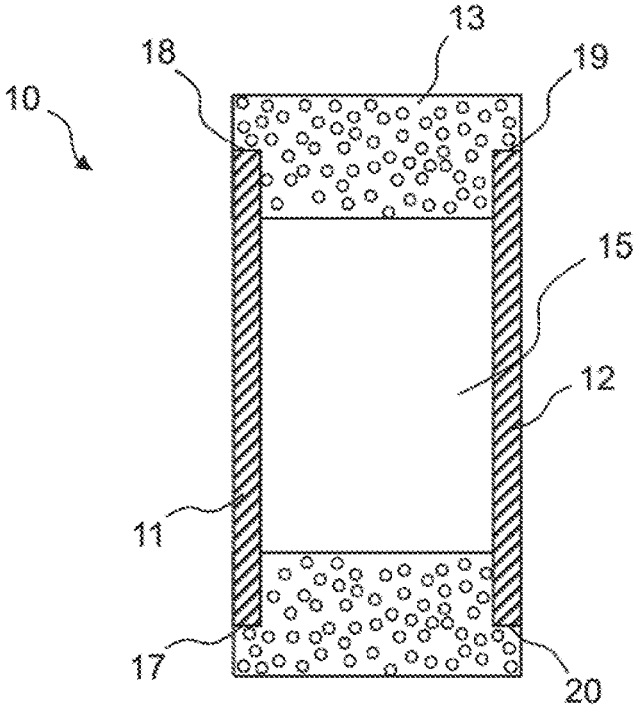
FIG. 4 shows a schematic sectional view of a further embodiment of an insulation device for a door of the domestic cooking appliance according to FIG. 1.

FIG. 4 shows a schematic sectional view of a further exemplary embodiment of the insulation device 10. The insulation device 10 according to FIG. 4 only differs from the insulation device according to FIGS. 2 and 3 in that the frame 13 projects beyond end faces 17 to 20 of the panes 11, 12. The frame 13 can also simply rest on the panes 11, 12 on the end faces 17 to 20 or be connected thereto.

Figure 5:
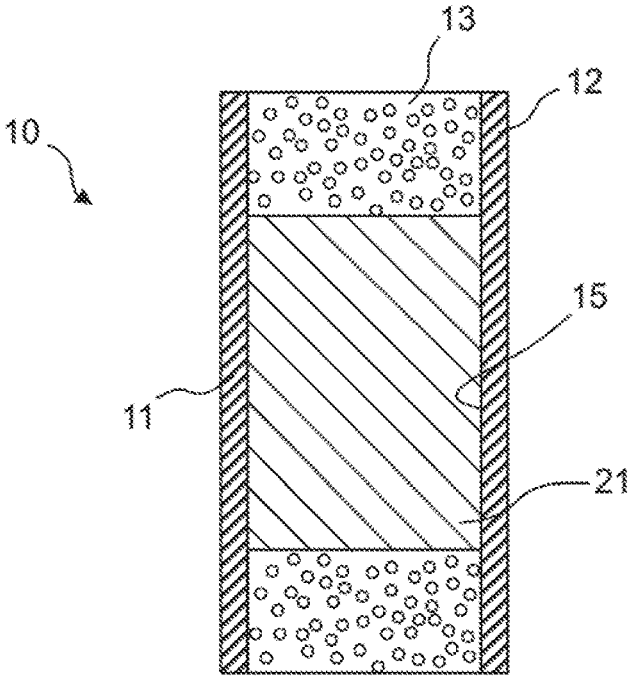
FIG. 5 shows a schematic sectional view of a further embodiment of an insulation device for a door of the domestic cooking appliance according to FIG. 1.

As shown in a schematic sectional view in FIG. 5, an insulating body 21 for thermally insulating the cooking compartment 2 can be arranged in the gap 15 between the panes 11, 12. The first pane 11 preferably faces the cooking compartment 2. The second pane 12 preferably faces away from the cooking compartment 2. The insulating body 21 is preferably transparent. The insulating body 21 can comprise fumed silica, an aerogel, a xerogel and/or a cyrogel. As the abovementioned materials can be hygroscopic, the insulating body 21 must be encapsulated in a water-tight manner. The steam-tight encapsulation of the insulating body 21 is provided by the frame 13 and the panes 11, 12 connected to said frame 13. This means that the insulating body 21 is unable to absorb moisture.

Figure 6:
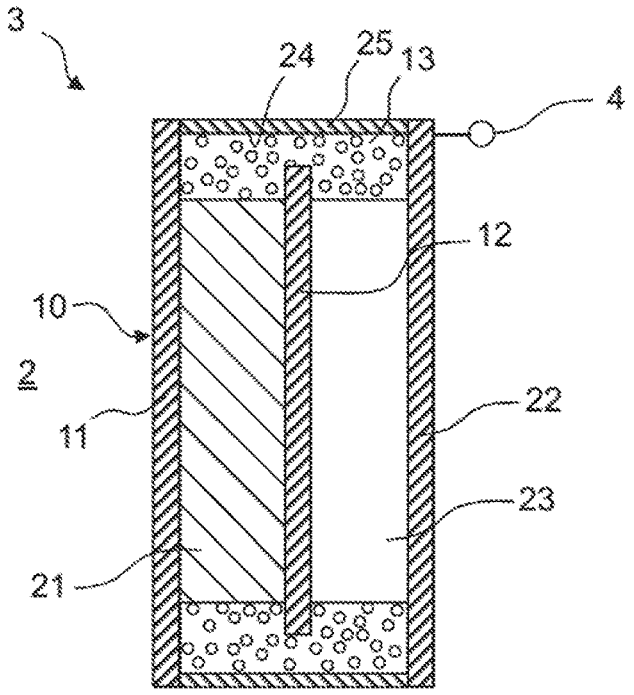
FIG. 6 shows a schematic sectional view of an embodiment of a door for the domestic cooking appliance according to FIG. 1.

FIG. 6 shows a schematic sectional view of an embodiment of a door 3 for the domestic cooking appliance 1. The door 3 comprises the insulation device 10. The door 3 also has a third pane 22. The second pane 12 of the insulating device 10 is arranged between the first pane 11 and the third pane 22 here. A gap 23 is provided between the second pane 12 and the third pane 22. The gap 23 can contain air for example. The frame 13 can connect all the panes 11, 12, 22 to one another. Alternatively an additional frame element can be provided, connecting the insulation device 10 to the third pane 22. A cover 25 concealing the frame 13 can be provided on end surfaces 24 of the frame 13. The cover 25 preferably runs all the way around the frame 13. The cover 25 can be sheet steel for example. The cover 25 can also be printing, a coating or a finish on the frame 13.

The first pane 11 of the insulation device 10 faces the cooking compartment 2 in the embodiment of the door 3 according to FIG. 6. As the insulating body 21 is only heat-resistant up to a certain temperature range, the embodiment of the door 3 according to FIG. 6 is preferably suitable for domestic cooking appliances 1 without pyrolysis function. In particular the first or inner pane 11 can be made of a low-cost soda lime glass. The door 3 can preferably not be dismantled so contamination of the gaps 15, 23 is reduced to a minimum.

Figure 7:
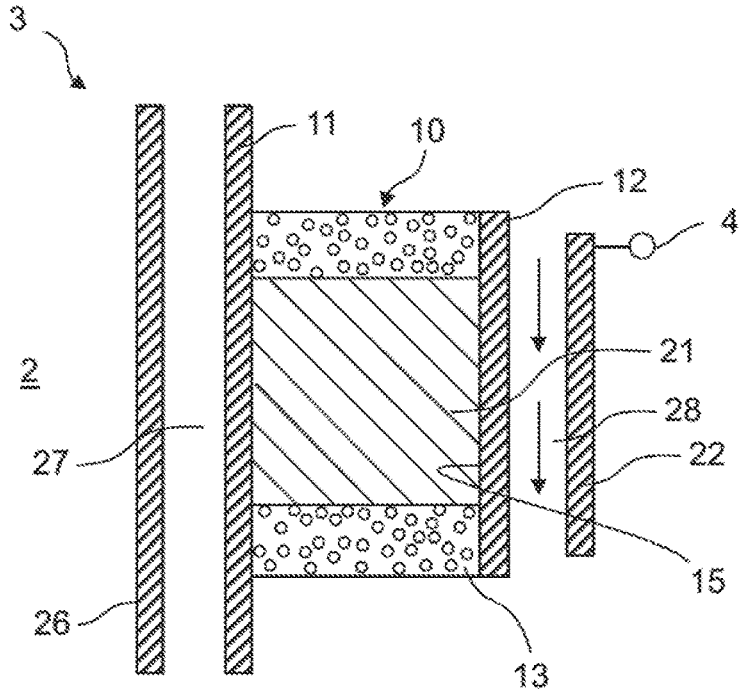
FIG. 7 shows a schematic sectional view of a further embodiment of a door for the domestic cooking appliance according to FIG. 1.

FIG. 7 shows a schematic sectional view of a further embodiment of a door 3 for the domestic cooking appliance. The embodiment of the door 3 according to FIG. 7 only differs from the embodiment of the door 3 according to FIG. 6 by a fourth pane 26. The fourth pane 26 is positioned facing the cooking compartment 2. The insulation device 10 is positioned between the third pane 22 and the fourth pane 26. In particular the first pane 11 and the second pane 12 are arranged between the third pane 22 and the fourth pane 26.

A gap 27, in particular an air gap, is provided between the first pane 11 and the fourth pane 26. The air gap acts in an insulating manner so that even during pyrolysis operation the insulating body 21, which is arranged between the first pane 11 and the second pane 12, is not exposed to too high a temperature. A gap 28, in particular an air gap, is also preferably provided between the second pane 12 and the third pane 22. Air can pass through the gap 28, as shown by arrows in FIG. 7. The insulation device 10 and the panes 22, 26 are preferably connected to one another by means of a frame (not shown). The frame can be a plastic frame or a metal frame for example.

Although the present invention has been described with reference to exemplary embodiments, it can be modified in many ways.

The invention claimed is:

1. An insulation device for a door of a domestic cooking appliance, said insulation device comprising:

a first pane having a first perimeter region and a transparent first central region, the first pane being a first material in both the first perimeter region and the transparent first central region;

a second pane having a second perimeter region and a transparent second central region, the second pane being a second material in both the second perimeter region and the transparent second central region; and a frame arranged between the first perimeter region and the second perimeter region and connected thereto such that the first central region and the second central region are completely surrounded by, and located remotely from, the frame, wherein the frame is made of a foam material.

2. The insulation device of claim 1, wherein the foam material is a foamed inorganic material.

3. The insulation device of claim 1, wherein the foam material is closed-pore.

4. The insulation device of claim 1, wherein the foam material is configured so as to be impermeable to steam.

5. The insulation device of claim 1, wherein the foam material is a foam glass.

6. The insulation device of claim 1, wherein the frame is bonded to the first and second panes.

7. The insulation device of claim 1, wherein the first and second panes define a gap there between, said frame sized to extend beyond the gap and over edges of the first and second panes.

8. The insulation device of claim 1, further comprising an insulating body arranged between the first central region and the second central region, the insulating body being a thermal insulator.

9. The insulation device of claim 8, wherein the insulating body is transparent.

10. The insulation device of claim 8, wherein the insulating body comprises a member selected from the group consisting of fumed silica, an aerogel, a xerogel, a cyrogel, and any combination thereof.

11. The insulation device of claim 1, wherein at least one of the first and second panes is made of a soda lime glass or a borosilicate glass.

12. A door for a domestic cooking appliance, the door comprising:

an attachment to the domestic cooking appliance;

an insulation device comprising a first pane having a first perimeter region and a transparent first central region, the first pane being a first material in both the first perimeter region and the transparent first central region, a second pane having a second perimeter region and a transparent second central region, the second pane being a second material in both the second perimeter region and the transparent second central region, and a frame arranged between the first perimeter region and the second perimeter region and connected thereto such that the first central region and the second central region are completely surrounded by, and located remotely from, the frame, wherein the frame is made of a foam material.

13. The door of claim 12, further comprising a third pane, said second pane being arranged between the first pane and the third pane, the third pane having a transparent third central region.

14. The door of claim 13, further comprising a fourth pane, said first and second panes being arranged between the third pane and the fourth pane, the fourth pane having a transparent fourth central region.

15. A domestic cooking appliance for cooking a food item, comprising:

a cooking compartment for containing the food item to be cooked; and a door for reversibly closing off the cooking compartment, the door including an insulation device comprising a first pane having a first perimeter region and a transparent first central region, the first pane being a first material in both the first perimeter region and the transparent first central region, a second pane having a second perimeter region and a transparent second central region, the second pane being a second material in both the second perimeter region and the transparent second central region, and a frame arranged between the first perimeter region and the second perimeter region and connected thereto such that the first central region and the second central region are completely surrounded by, and located remotely from, the frame, wherein the frame is made of a foam material.

16. The domestic cooking appliance of claim 15, further comprising an insulating body arranged between the first central region and the second central region, the insulating body being a thermal insulator.

17. The domestic cooking appliance of claim 16, wherein the insulating body is transparent.

18. The domestic cooking appliance of claim 15, further comprising a third pane, said second pane being arranged between the first pane and the third pane, the third pane having a transparent third central region.

19. The door of claim 12, further comprising an insulating body arranged between the first central region and the second central region, the insulating body being a thermal insulator.

20. The door of claim 19, wherein the insulating body is transparent.

* * * * *